US006276614B1

(12) United States Patent
Huang

(10) Patent No.: US 6,276,614 B1
(45) Date of Patent: Aug. 21, 2001

(54) SHOWER HEAD STRUCTURE

(75) Inventor: So-Mel Huang, Tai Ping (TW)

(73) Assignee: Chien Chuen Plastic Co., Ltd., Taichung (TW)

( * ) Notice: Subject to any disclaimer, the term of this patent is extended or adjusted under 35 U.S.C. 154(b) by 0 days.

(21) Appl. No.: 09/657,173

(22) Filed: Sep. 7, 2000

(51) Int. Cl.[7] ..... B05B 1/34

(52) U.S. Cl. ..... 239/383; 4/567; 4/615; 239/222.17; 239/382; 239/381; 239/447

(58) Field of Search ..... 4/567–570, 601, 4/615, 618; 239/222.17, 381–383, 380, 436, 446, 447, 556, 561, 449

(56) References Cited

U.S. PATENT DOCUMENTS 4,203,550 * 5/1980 On ..... 239/447
4,254,914 * 3/1981 Shames et al. ..... 239/383
4,398,669 * 8/1983 Fienhold ..... 239/447
5,356,077 * 10/1994 Shames et al. ..... 239/383
5,476,225 * 12/1995 Chan ..... 239/449

* cited by examiner

*Primary Examiner*—Gregory L. Huson
*Assistant Examiner*—Tuan Nguyen
(74) *Attorney, Agent, or Firm*—Rosenberg, Klein & Lee

(57) ABSTRACT

A shower head structure includes an outer housing, a water exciting vane wheel, a water outlet cover, and a water guide barrel. The outer housing contains a ball connector, and a sealing ring pressing the ball connector. The water exciting vane wheel includes a central hollow bushing, a plurality of curved vanes, and a catch plate. The water outlet cover defines multiple straight water outlet apertures and three massaging water outlet apertures and includes an annular water dispensing barrel provided with a short stub. The water guide barrel includes a first step provided with an enlarged opening tightly pressing the sealing ring and a second step provided with a reduced section provided with a vane wheel shaft extending through the hollow bushing of the water exciting vane wheel and defining a receiving hole securing the short stub of the water dispensing barrel. The reduced section of the water guide barrel defines three oblique cut water outlet ports facing the vanes of the water exciting vane wheel.

1 Claim, 5 Drawing Sheets

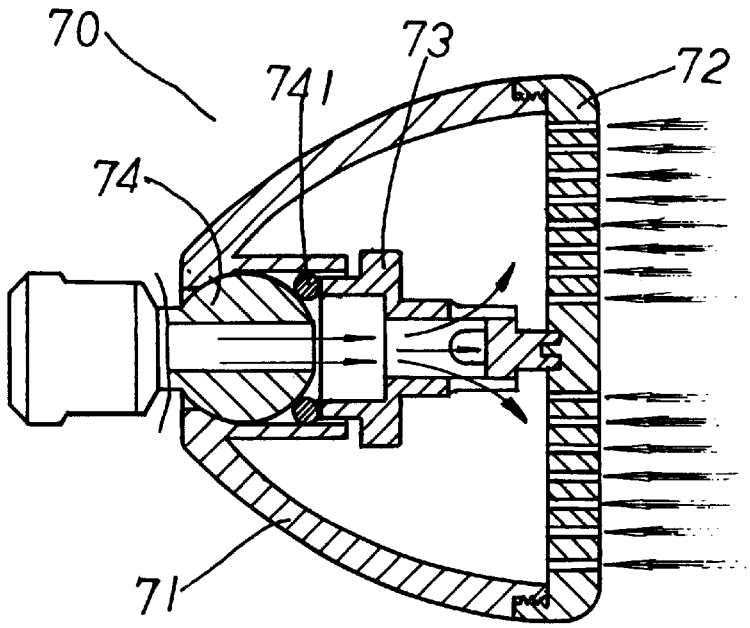
PRIOR ART FIG. 1
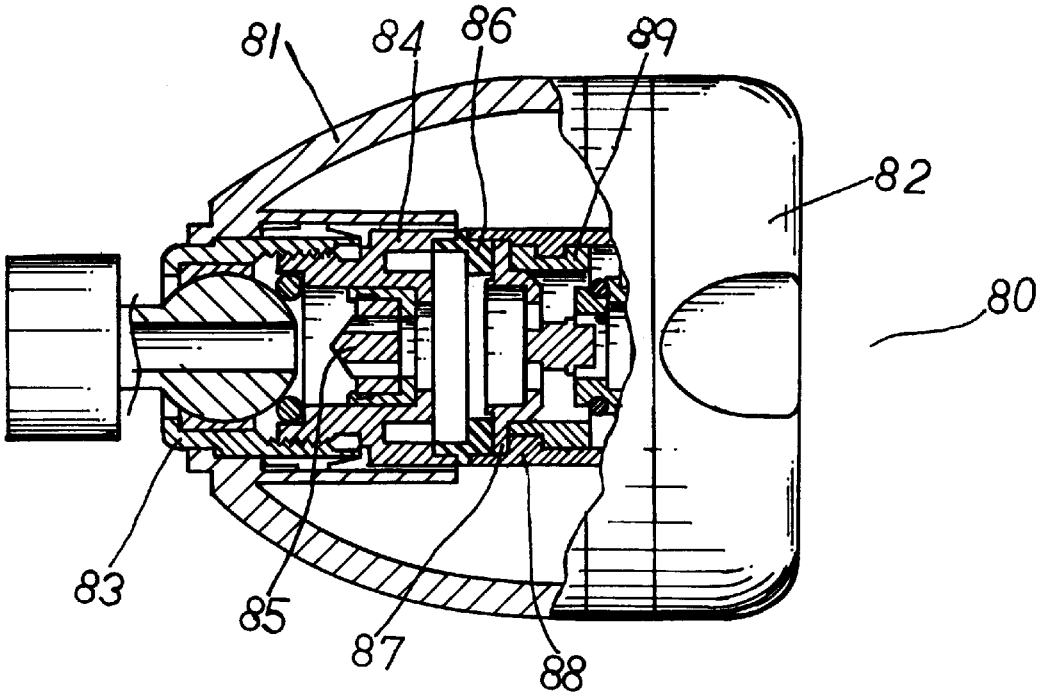
PRIOR ART FIG. 2

SHOWER HEAD STRUCTURE

BACKGROUND OF THE INVENTION

1. Field of the Invention

The present invention relates to a shower head structure.

2. Description of the Related Art

A first conventional shower head 70 in accordance with the prior art shown in FIG. 1 is mounted on the wall of the bathroom and comprises a housing 71 containing a ball connector 74 and a sealing ring 741 therein, a water outlet cover 72 secured on the housing 71, and a water guide barrel 73 secured between the sealing ring 741 and the water outlet cover 72.

A second conventional shower head 80 in accordance with the prior art shown in FIG. 2 is mounted on the wall of the bathroom and comprises a housing 81, a water outlet cover 82, and many parts 83, 84, 85, 86, 87, 88 and 89 so that the shower head 80 has a complex construction, thereby greatly increasing the cost of fabrication.

A third conventional shower head in accordance with the prior art shown in FIG. 3 is a hand holding type shower head and comprises a housing 91, a water outlet cover 92, and many parts 89, 94, 95, 96, 97 and 98 so that the shower head also has a complex construction, thereby greatly increasing the cost of fabrication.

SUMMARY OF THE INVENTION

In accordance with one aspect of the present invention, there is provided a shower head structure comprising:

an outer housing, a water exciting vane wheel, a water outlet cover, and a two-step shaped water guide barrel, wherein, the outer housing defines a fitting chamber pivotally receiving therein a ball connector which is locked to a water pipe of a wall for introducing water into the outer housing, a sealing ring mounted between the fitting chamber and the ball connector;

the water exciting vane wheel includes a central hollow bushing, a plurality of curved vanes secured on the hollow bushing, and a catch plate secured on one of the curved vanes;

the water outlet cover has a circular surface including an outer ring defining a straight water outlet zone defining multiple straight water outlet apertures and an inner ring defining three equally spaced massaging water outlet apertures, the water outlet cover has an inner surface provided with an annular water dispensing barrel located between the inner ring and the outer ring for defining an inner water outlet zone and an outer water outlet zone connecting with each other, the water dispensing barrel having a center provided with a short stub;

the water guide barrel includes a first step provided with an enlarged opening tightly pressing the sealing ring and a second step provided with a reduced section provided with a vane wheel shaft extending through the hollow bushing of the water exciting vane wheel and defining a receiving hole for securing the short stub of the water dispensing barrel therein, the reduced section of the water guide barrel defining three oblique cut water outlet ports facing the vanes of the water exciting vane wheel.

In accordance with another aspect of the present invention, the shower head structure is a hand holding type shower head structure co-operates with an outer housing which includes a hollow holding section connected to a water guide hose, and includes a water outlet end provided with an enlarged circular hollow head having an opening provided with an inner thread for engaged with the water outlet cover, the hollow head of the outer housing has an inner bottom provided with a support base for receiving a sealing ring facing the enlarged opening of the water guide barrel.

Further benefits and advantages of the present invention will become apparent after a careful reading of the detailed description with appropriate reference to the accompanying drawings.

BRIEF DESCRIPTION OF THE DRAWINGS

FIG. 1 is a side plan cross-sectional view of a first conventional shower head in accordance with the prior art;

FIG. 2 is a side plan cross-sectional view of a second conventional shower head in accordance with the prior art;

DETAILED DESCRIPTION OF THE INVENTION

Figure 3:
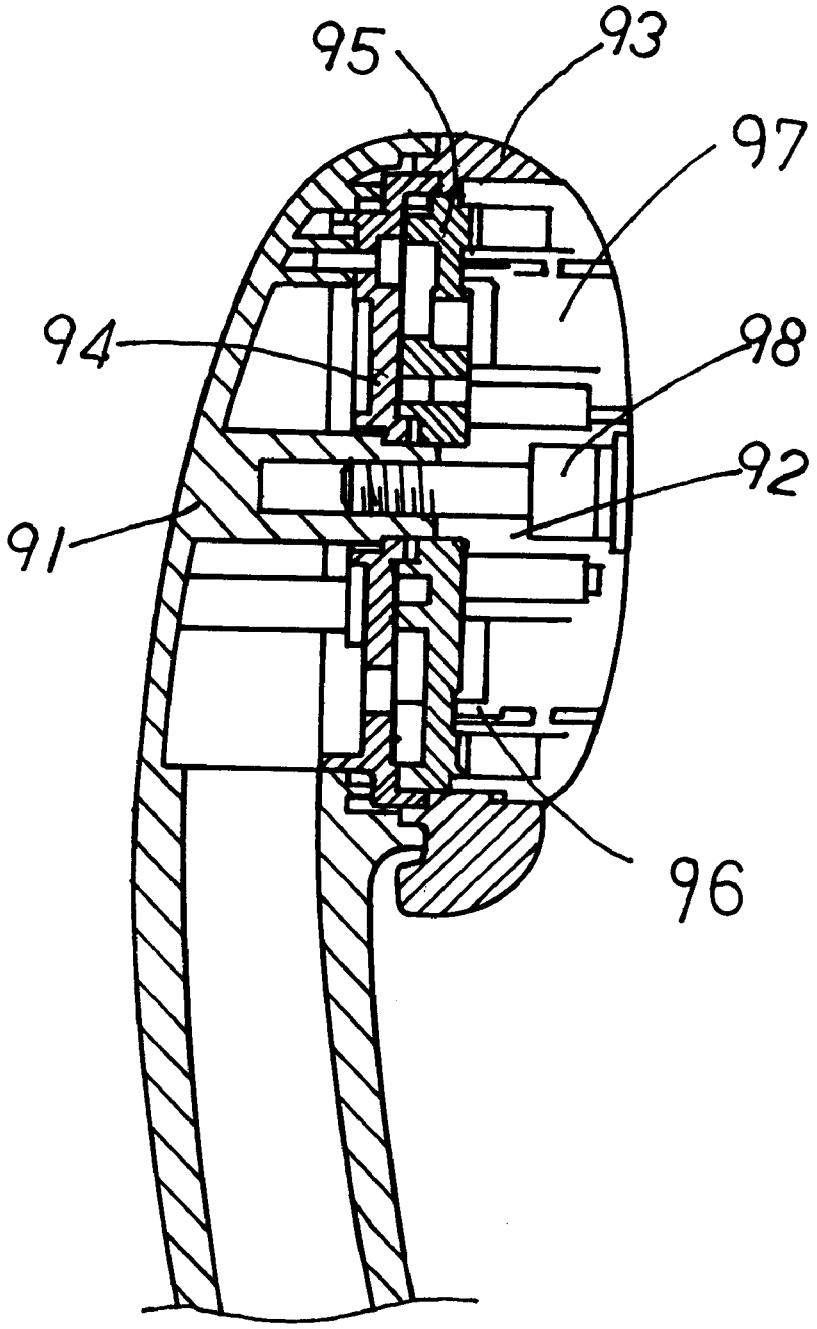
FIG. 3 PRIOR ART
FIG. 3 is a side plan cross-sectional view of a third conventional shower head in accordance with the prior art.
Figure 4:
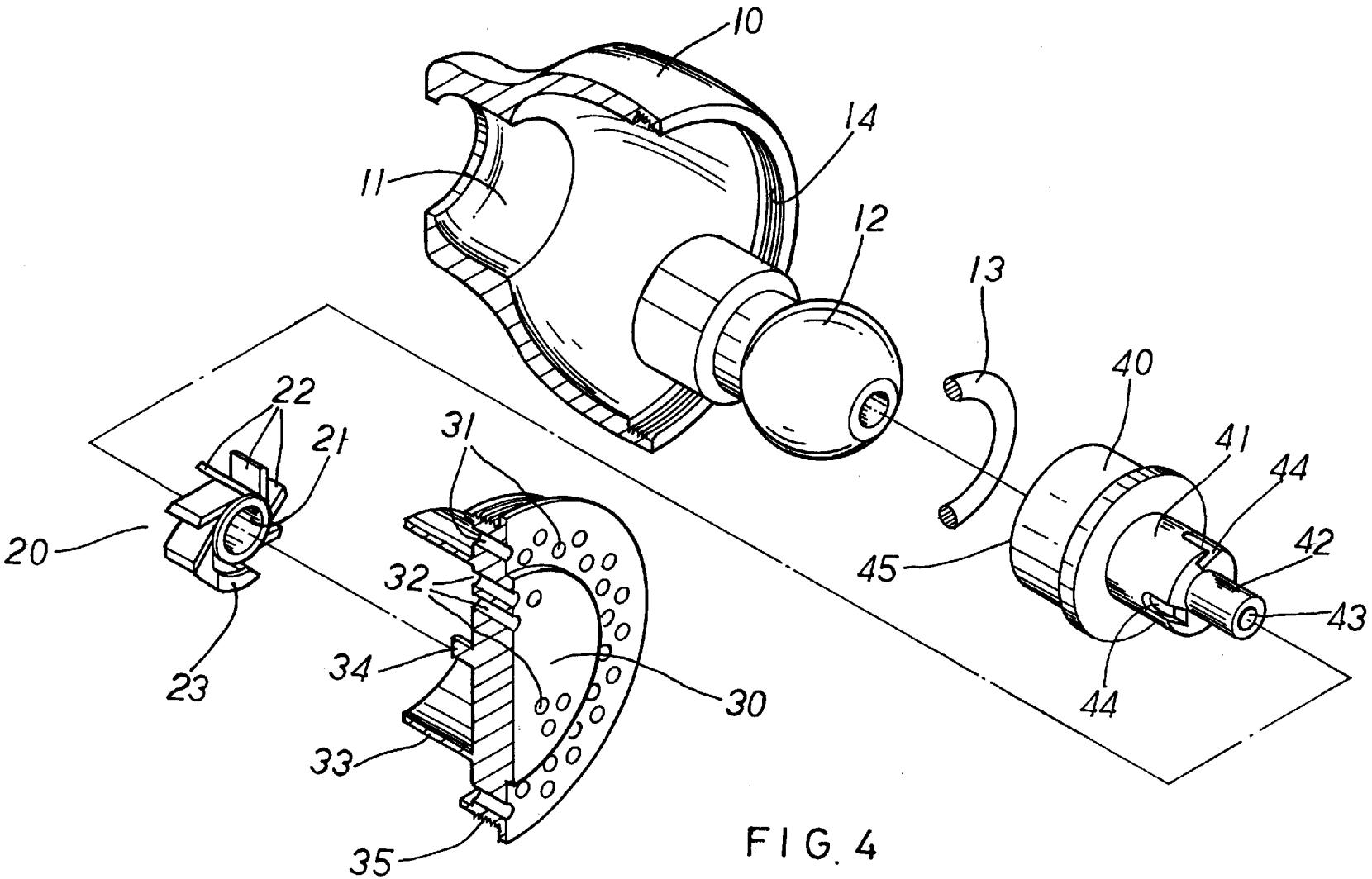
FIG. 4 is an exploded view of a shower head structure in accordance with the present invention.
Figure 5:
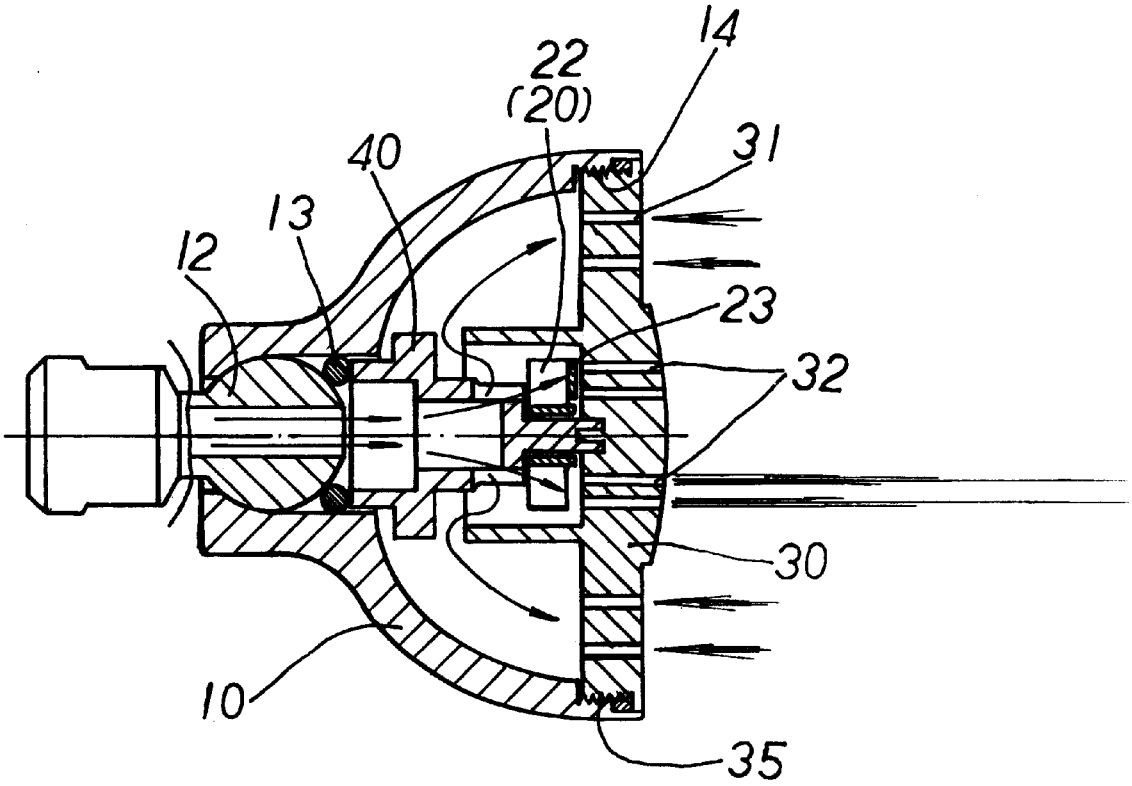
FIG. 5 is a side plan cross-sectional assembly view of the shower head structure as shown in FIG. 4.

Referring to the drawings and initially to FIGS. 4 and 5, a shower head structure in accordance with the present invention comprises an outer housing 10, a water exciting vane wheel 20, a water outlet cover 30, and a two-step shaped water guide barrel 40.

The outer housing 10 has a first end provided with an inner thread 14 and a second end defining a fitting chamber 11 for pivotally receiving therein a ball connector 12 which is locked to a water pipe of a wall for introducing water into the outer housing 10. A sealing ring 13 is mounted between the fitting chamber 11 and the ball connector 12.

The water exciting vane wheel 20 includes a central hollow bushing 21, a plurality of curved vanes 22 secured on the hollow bushing 21, and a catch plate 23 secured on one of the curved vanes 22.

The water outlet cover 30 has an outer periphery provided with an outer thread 35 screwed on the inner thread 14 of the outer housing 10 for securing the water outlet cover 30 on the outer housing 10. The water outlet cover 30 has a circular surface including an outer ring defining a straight water outlet zone defining multiple straight water outlet apertures 31 and an inner ring defining three equally spaced massaging water outlet apertures 32. The water outlet cover 30 has an inner surface provided with an annular water dispensing barrel 33 located between the inner ring and the outer ring for defining an inner water outlet zone and an outer water outlet zone connecting with each other. The water dispensing barrel 33 has a center provided with a short stub 34.

The water guide barrel 40 includes a first step provided with an enlarged opening 45 tightly pressing the sealing ring 13 and a second step provided with a reduced section 41 provided with a vane wheel shaft 42 extending through the hollow bushing 21 of the water exciting vane wheel 20 and defining a receiving hole 43 for securing the short stub 34 of the water dispensing barrel 33 therein. The reduced section 41 of the water guide barrel 40 defines three oblique cut water outlet ports 44 facing the vanes 22 of the water exciting vane wheel 20.

In operation, the water is introduced through the ball connector 12 into the water guide barrel 40. The shoulder of the enlarged opening 45 of the water guide barrel 40 is spaced a distance from the water dispensing barrel 33 of the water outlet cover 30 so that the inner water outlet zone and an outer water outlet zone connect with each other. The water in the enlarged opening 45 is compressed through the reduced section 41 of the water guide barrel 40, and is then injected outward through the three water outlet ports 44 to drive the water exciting vane wheel 20 so as to rotate the vanes 22. The catch plate 23 is rotated with the vane 22 to in turn close one of the three massaging water outlet apertures 32 whereby the water is injected through the three massaging water outlet apertures 32 intermittently, thereby providing a massaging effect to the user.

Partial of the water can be introduced through the space between the shoulder of the water guide barrel 40 and the water dispensing barrel 33 to the outer water outlet zone to be ejected outward through the straight water outlet apertures 31.

In such a manner, the shower head structure of the present invention can eject water outward through the three massaging water outlet apertures 32 intermittently, and through the straight water outlet apertures 31, thereby increasing the versatility of the shower head structure.

Figure 6:
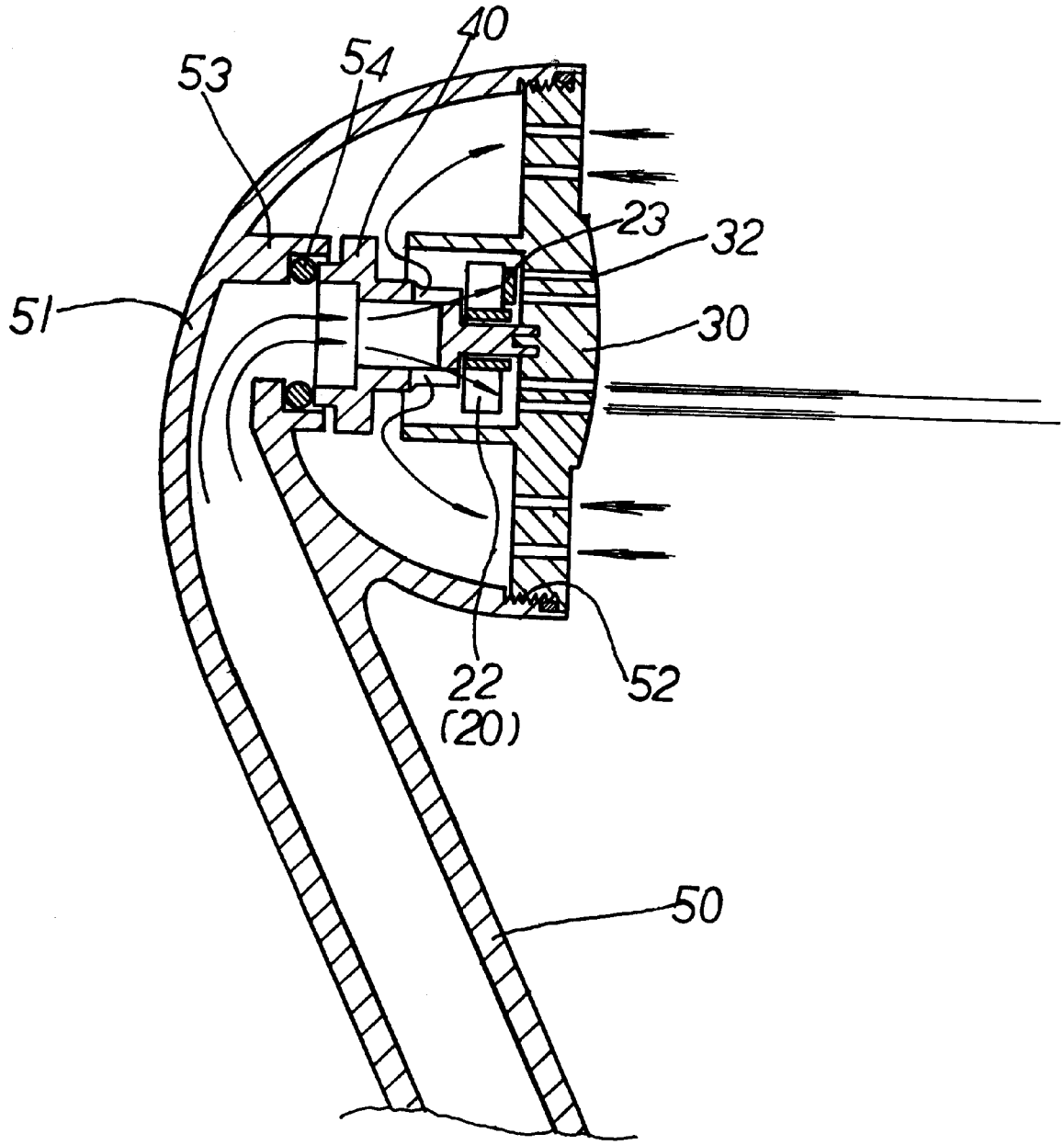
FIG. 6 is a side plan cross-sectional view of a shower head structure in accordance with another embodiment of the present invention.

Referring to FIG. 6, in accordance with another embodiment of the present invention, the shower head structure is a hand holding type shower head structure co-operates with an outer housing 50 which includes a hollow holding section connected to a water guide hose, and includes a water outlet end provided with an enlarged circular hollow head 51 having an opening provided with an inner thread 52 for engaged with the water outlet cover 30. The hollow head 51 of the outer housing 50 has an inner bottom provided with a support base 53 for receiving a sealing ring 54 facing the enlarged opening 45 of the water guide barrel 40.

Accordingly, the shower head structure of the present invention can be directly mounted on the wall and can be adapted to co-operate with a hand holding type outer housing, thereby increasing the versatility of the shower head structure.

It should be clear to those skilled in the art that further embodiments may be made without departing from the scope of the present invention.

What is claimed is:

1. A shower head structure comprising:

an outer housing (10), a water exciting vane wheel (20), a water outlet cover (30), and a two-step shaped water guide barrel (40), wherein, said outer housing (10) defines a fitting chamber (11) pivotally receiving therein a ball connector (12) which is locked to a water pipe of a wall for introducing water into said outer housing (10), a sealing ring (13) mounted between said fitting chamber (11) and said ball connector (12);

said water exciting vane wheel (20) includes a central hollow bushing (21), a plurality of curved vanes (22) secured on said hollow bushing (21), and a catch plate (23) secured on one of said curved vanes (22);

said water outlet cover (30) has a circular surface including an outer ring defining a straight water outlet zone defining multiple straight water outlet apertures (31) and an inner ring defining three equally spaced massaging water outlet apertures (32), said water outlet cover (30) has an inner surface provided with an annular water dispensing barrel (33) located between said inner ring and said outer ring for defining an inner water outlet zone and an outer water outlet zone connecting with each other, said water dispensing barrel (33) having a center provided with a short stub (34);

said water guide barrel (40) includes a first step provided with an enlarged opening (45) tightly pressing said sealing ring (13) and a second step provided with a reduced section (41) provided with a vane wheel shaft (42) extending through said hollow bushing (21) of said water exciting vane wheel (20) and defining a receiving hole (43) for securing said short stub (34) of said water dispensing barrel (33) therein, said reduced section (41) of said water guide barrel (40) defining three oblique cut water outlet ports (44) facing said vanes (22) of said water exciting vane wheel (20).

* * * * *